US008291840B2

(12) United States Patent
Baracchia

(10) Patent No.: US 8,291,840 B2
(45) Date of Patent: Oct. 23, 2012

(54) TABLE WITH ADJUSTABLE HEIGHT

(76) Inventor: Paolo Baracchia, Rome (IT)

( * ) Notice: Subject to any disclaimer, the term of this patent is extended or adjusted under 35 U.S.C. 154(b) by 0 days.

(21) Appl. No.: 13/059,920

(22) PCT Filed: Dec. 31, 2010

(86) PCT No.: PCT/IT2010/000526

§ 371 (c)(1),
(2), (4) Date: Feb. 18, 2011

(87) PCT Pub. No.: WO2011/086588

PCT Pub. Date: Jul. 21, 2011

(65) Prior Publication Data

US 2011/0232541 A1 Sep. 29, 2011

(30) Foreign Application Priority Data

Jan. 12, 2010 (IT) ..... RM2010A0005

(51) Int. Cl.
*A47B 9/20* (2006.01)

(52) U.S. Cl. ..... 108/147.19; 108/147.21; 248/188.5

(58) Field of Classification Search ..... 108/106, 108/110, 144.11, 146, 147.11, 147, 147.19, 108/147.2, 147.21, 147.22, 148; 248/188.5, 248/188.4, 188.2, 161, 157, 412, 411, 132, 248/125, 354.6, 354.3, 354.1, 415, 416
See application file for complete search history.

(56) References Cited

U.S. PATENT DOCUMENTS

| | | | | |
|---|---|---|---|---|
| 761,468 | A * | 5/1904 | Ford | 108/147.21 |
| 2,010,290 | A * | 8/1935 | Campbell | 108/148 |
| 4,580,804 | A * | 4/1986 | Weber | 248/188.5 |
| 4,615,279 | A * | 10/1986 | de la Haye | 108/147 |
| 5,513,578 | A * | 5/1996 | Tordsen | 108/147.19 |
| 5,513,825 | A * | 5/1996 | Gutgsell | 248/188.5 |
| 6,138,973 | A * | 10/2000 | Woodward | 248/188.5 |
| 6,886,788 | B1 * | 5/2005 | Chung | 248/176.2 |
| 7,997,215 | B2 * | 8/2011 | De Keyzer | 108/147 |
| 2003/0173479 | A1 * | 9/2003 | Garelick et al. | 248/188.5 |
| 2006/0145036 | A1 * | 7/2006 | Jones et al. | 248/188.5 |
| 2008/0121150 | A1 * | 5/2008 | Picchio | 108/147.19 |
| 2011/0232541 | A1 * | 9/2011 | Barracchia | 108/147.19 |

FOREIGN PATENT DOCUMENTS

| | | | |
|---|---|---|---|
| DE | 19934484 | A1 | 5/2001 |
| DE | 10001473 | A1 | 7/2001 |
| DE | 202004020323 | U1 | 4/2005 |
| EP | 0873700 | A2 | 10/1998 |
| EP | 1574149 | A1 | 9/2005 |
| GB | 455552 | A | 10/1936 |

* cited by examiner

OTHER PUBLICATIONS

International Search report issued on May 18, 2011, in corresponding International Application No. PCT/T2010/000526.

*Primary Examiner* — Jose V Chen
(74) *Attorney, Agent, or Firm* — Mark Terry

(57) ABSTRACT

Table, screwed on the floor by a sliding helix telescopic base itself screwed to the table-top in eccentric position, characterized by raising phase, lowering phase and simultaneously twisting of 180 degrees that allows the table-top to reduce the distance from seating during the raising phase and increment the distance during the lowering phase.

Table is characterized by the presence of two elements that work at same time: the base and the table-top. The base is composed by two concentric Cylinders, "A Cylinder" and "B Cylinder". The first Cylinder is screwed on the floor bolts using own flange interface while the "B Cylinder", screwed on the table-top in eccentric position by bolts using own top flange interface. The table-top is the deck able to support different seating configurations(dining-table and couch-table).

19 Claims, 9 Drawing Sheets

TABLE WITH ADJUSTABLE HEIGHT

"This patent application claims priority to international patent application PCT/IT2010/000526, filed on Dec. 31, 2010, which further claims priority to Italian patent application RM2010A000005, filed on Jan. 12, 2010. The subject matter of international patent application PCT/IT2010/000526 and Italian patent application RM2010A000005 are hereby incorporated by reference in their entirety."

TECHNICAL FIELD

The present industrial invention consists of a table screwed on the floor by a sliding helix telescopic base itself screwed to the table-top in eccentric position.

BACKGROUND ART

The existing products allow only adapting the table-top to different height levels from the floor but they do not solve the issue related to the distance between table-top and height of seating.

The present invention solves the technical problem of the distance between table-top and height of seating by using unique technical solutions.

In addition, the present invention solves the clearance technical problem and guarantees an high security level inside small ambient as can be yachts.

DISCLOSURE OF INVENTION

The technical specification of the invention allows to the table-top to vary its attitude from couch-table to dining-table, and vice versa, avoiding the problem due to the height and distance variations of table-top from seating during the movement from lower to upper position (and vice versa).

The couch-table position requires 45-50 cm from the floor and enough space form table-top and the seating to allow a comfortable access. The dining-table configuration requires 70-80 cm from the floor and different room from the seating to he comfortable during the meal time. The invention includes a combination of two essential elements that take place at same time: the sliding helix telescopic base screwed on the floor and the table-top screwed to the base in eccentric position.

The sliding helix telescopic base is assembled using two concentric cylinders called "A Cylinder" and "B Cylinder".

The "B Cylinder", due to two helical longitudinal milling, slides between pivot anchors assembled on "A Cylinder". Considering this implementation, while the "A Cylinder" is in static position and screwed to the floor, the "B Cylinder" during the raising and lowering phase, simultaneously, force the table-top to have a rotation of 180 degrees.

In this way, the table-top screwed in eccentric position to the "B Cylinder", due to the twist of the helical longitudinal milling on pivot anchors, reduce the distance from seating during the raising phase and increment the distance during the lowering phase.

BRIEF DESCRIPTION OF DRAWINGS

The sliding helix telescopic base is composed by two concentric cylinder "A" and "B", FIG. 1 and FIG. 2.

The "A Cylinder"

Figure 1:
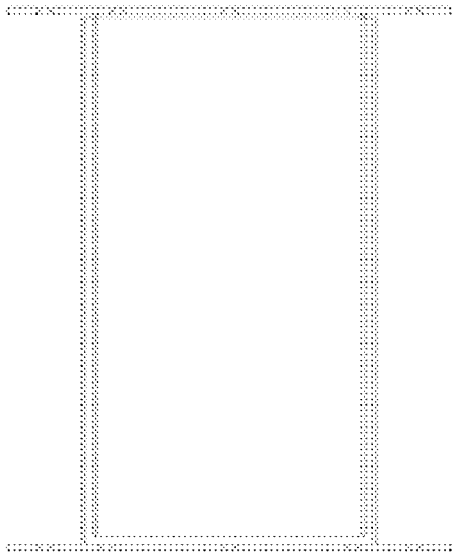
Figure 2:
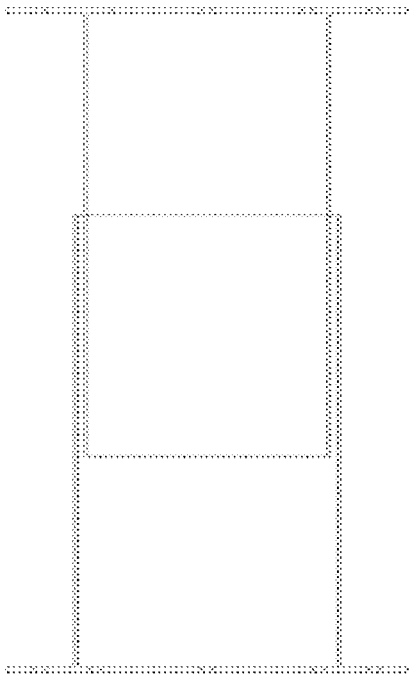
Figure 3:
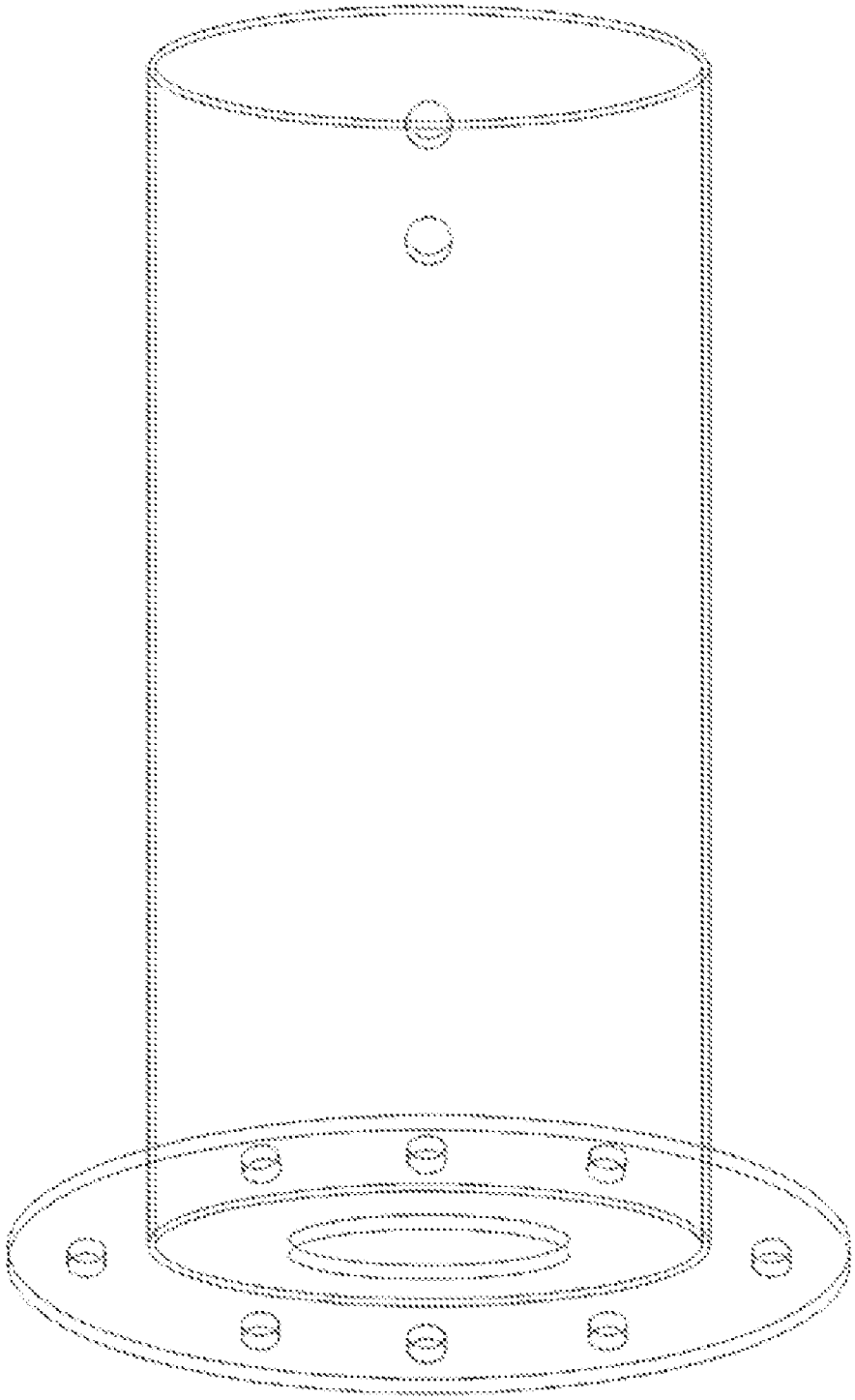
FIG. 3, is screwed to the floor by bolts using its flange interface, FIG. 4 and FIG. 8 (4).
Figure 4:
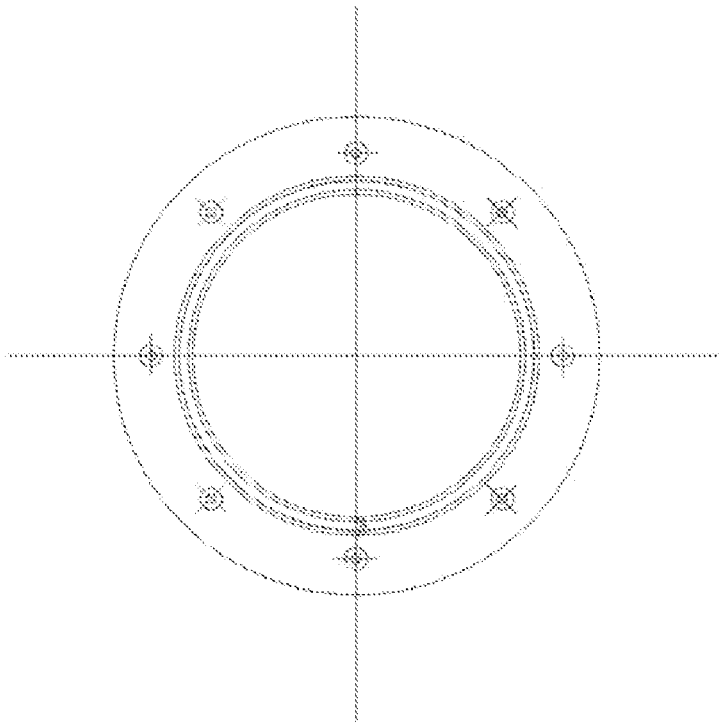
Figure 5:
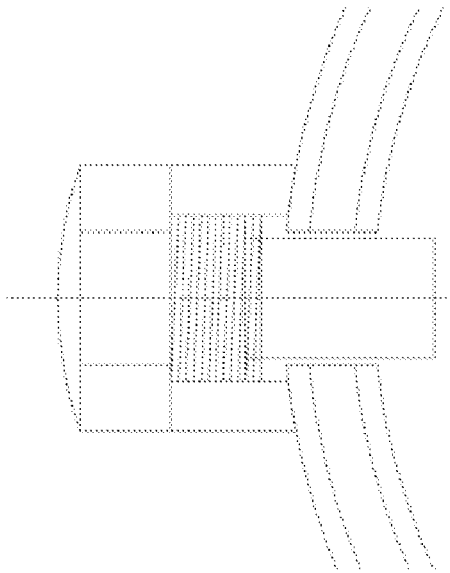
Figure 7:
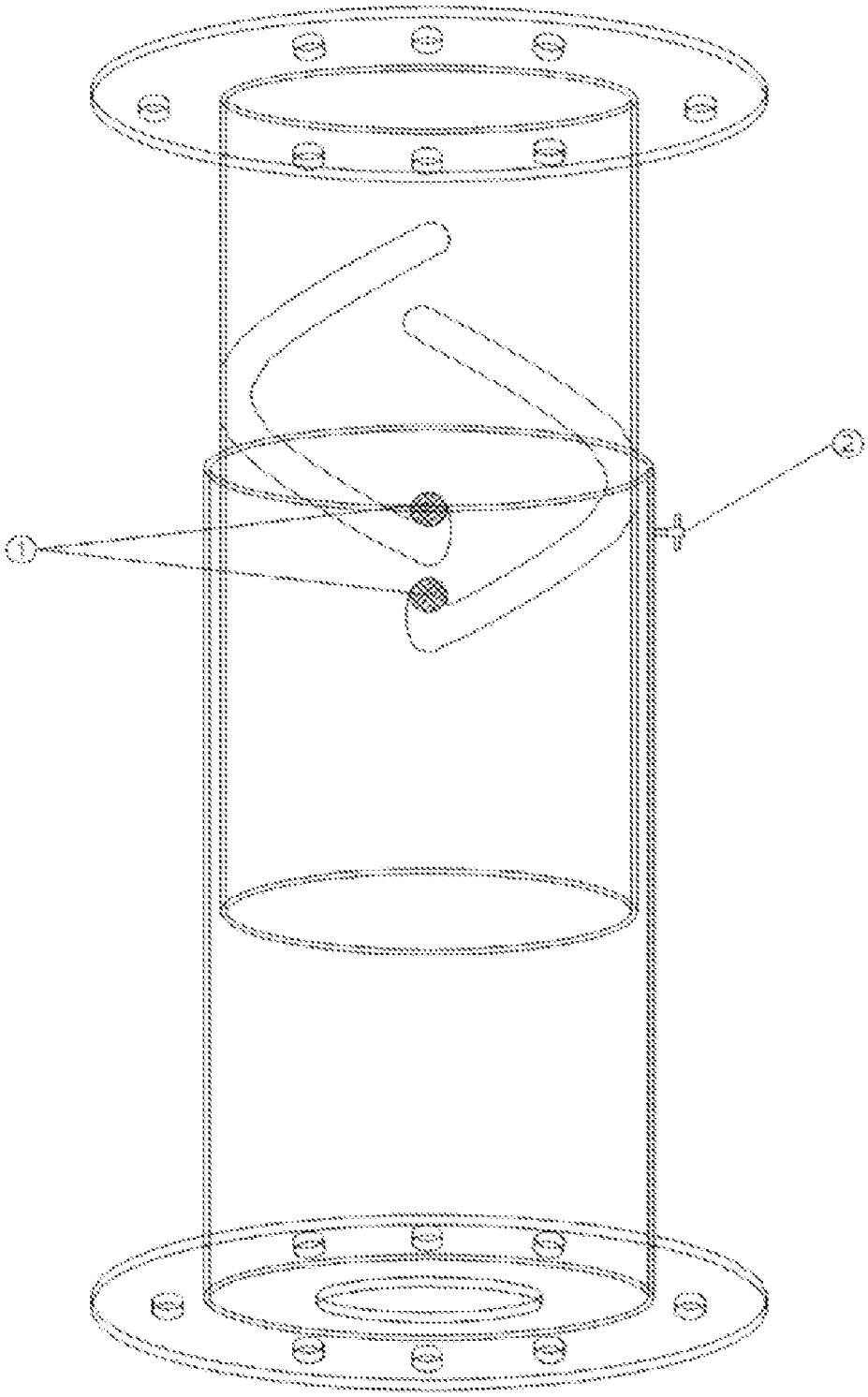
Figure 8:
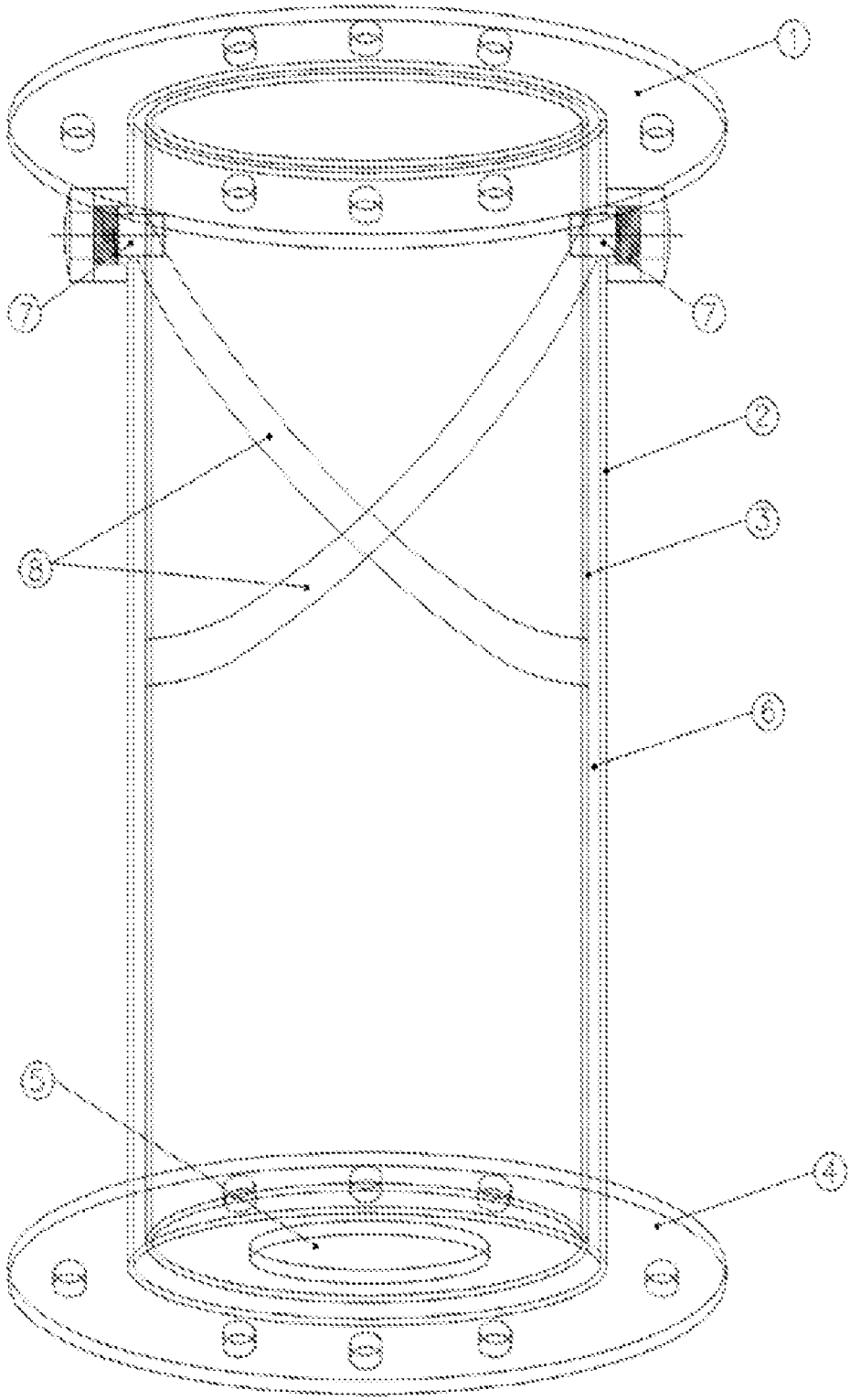

On top of "A Cylinder" are located two circular section holes on opposite side between them, FIG. 3 and FIG. 7 (1), that allow to house two pivot anchors, FIG. 5 and FIG. 8 (7). In the real implementation the pivot anchors can be replaced by a pass-through axle.

Figure 6:
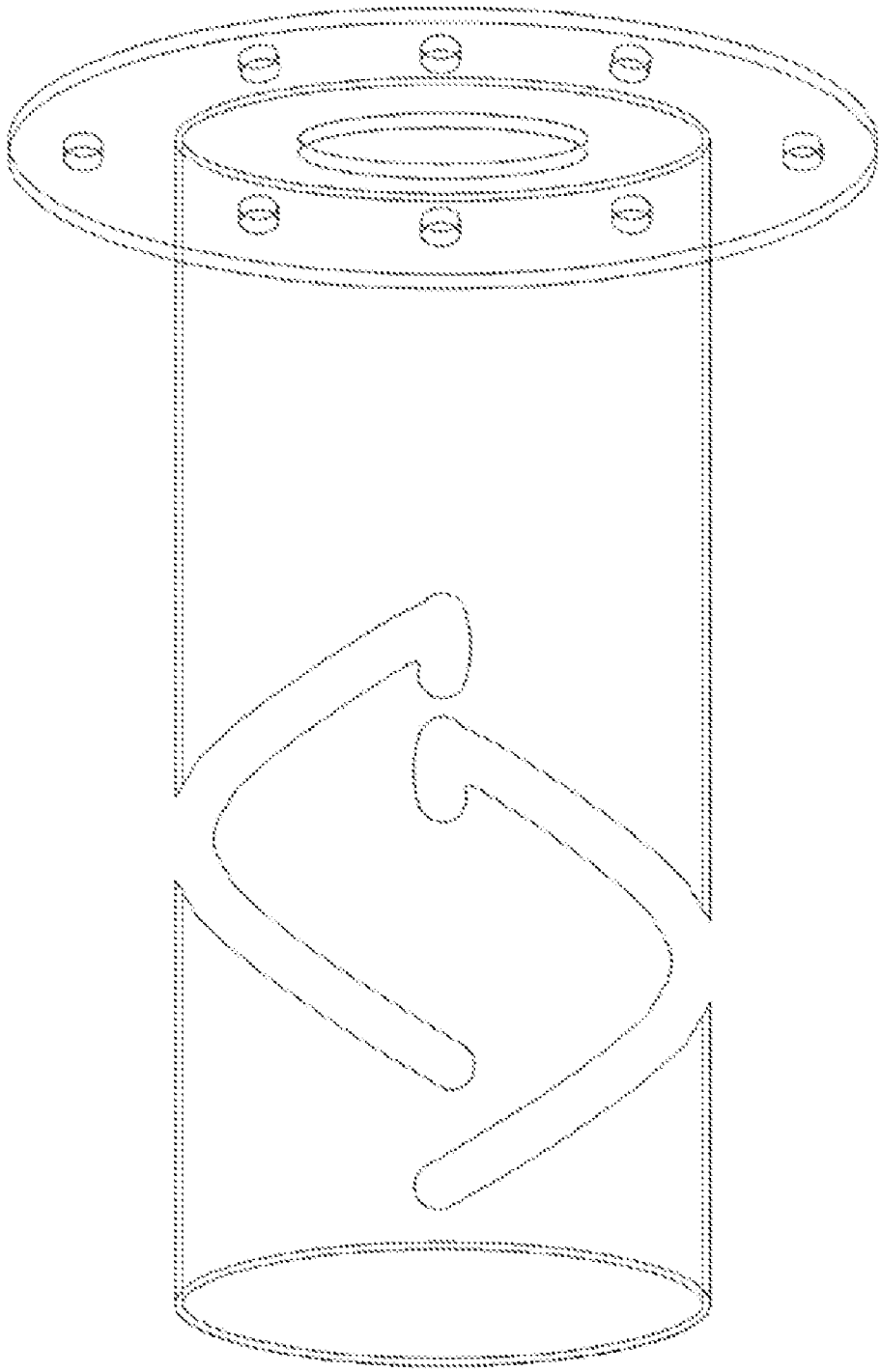

The "B Cylinder", FIG. 6, with diameter size smaller than "A Cylinder", FIG. 8 (3), is secured to the table-top in eccentric position using bolts to fix the cylinder flange located over the top of the cylinder itself, FIG. 8 (1).

The "B Cylinder" present two helical longitudinal millings positioned in opposite site one to each other, FIG. 8 (8).

The "B Cylinder" is screwed to "A Cylinder" by pivot anchors, FIG. 8 (7).

The "B Cylinder" can raise, FIG. 7, lower, FIG. 8, and simultaneously twist itself of 180 degrees, without any friction, thanks to the sliding of helical longitudinal milling on pivot anchors.

The "B Cylinder" during the raising phase reaches end stop holes located over the top of two helical longitudinal millings, FIG. 6. Pivot anchors will drop down to end stop holes, securing the "B Cylinder" in a fixed position "UP", FIG. 7 (1).

The drift bolt, located in a side of "A Cylinder" will provide an additional securing lock of the two Cylinders in a "UP" position, FIG. 7 (2).

The lowering phase of the "B Cylinder" can be performed unlocking the drift bolt and raising the table-top. The table-top raising action allows pivot anchors to be easily out from the end stop holes.

The Up, Down and twisting actions of "B Cylinder" can be performed manually or optionally can be installed, inside the "B Cylinder", a hydraulic actuator.

Another key element of the invention is the table-top. The "B Cylinder", due to two helical longitudinal milling, slides between pivot anchors assembled on "A Cylinder". Considering this implementation while the "A Cylinder" is in static position and screwed to the floor, the "B Cylinder" during the raising and lowering phase, simultaneously, force the table-top to have a rotation of 180 degrees.

Figure 9:
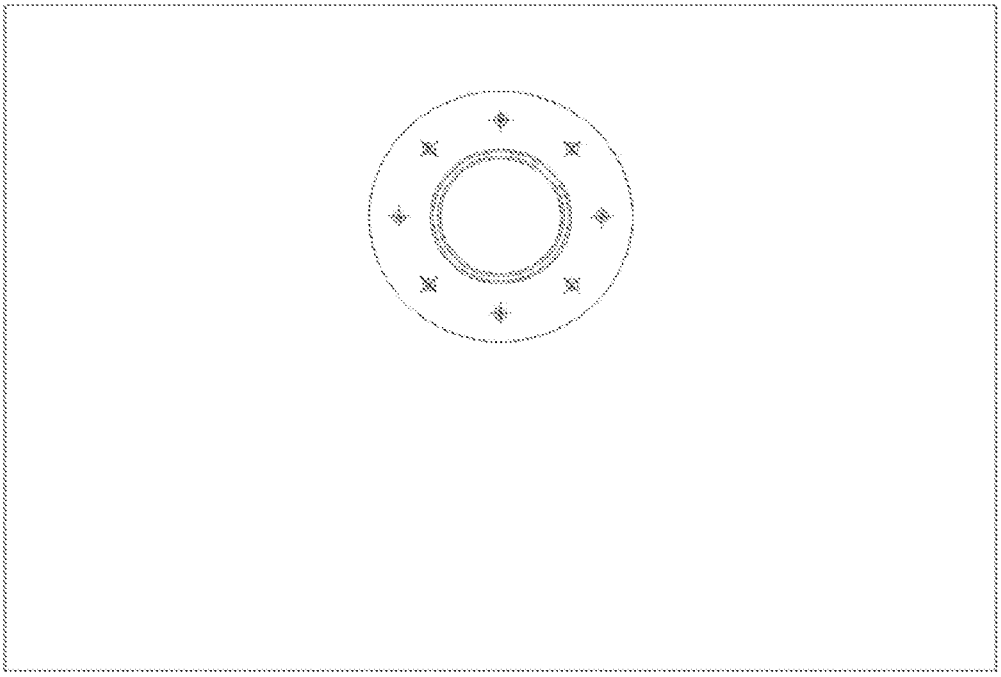
Figure 10:
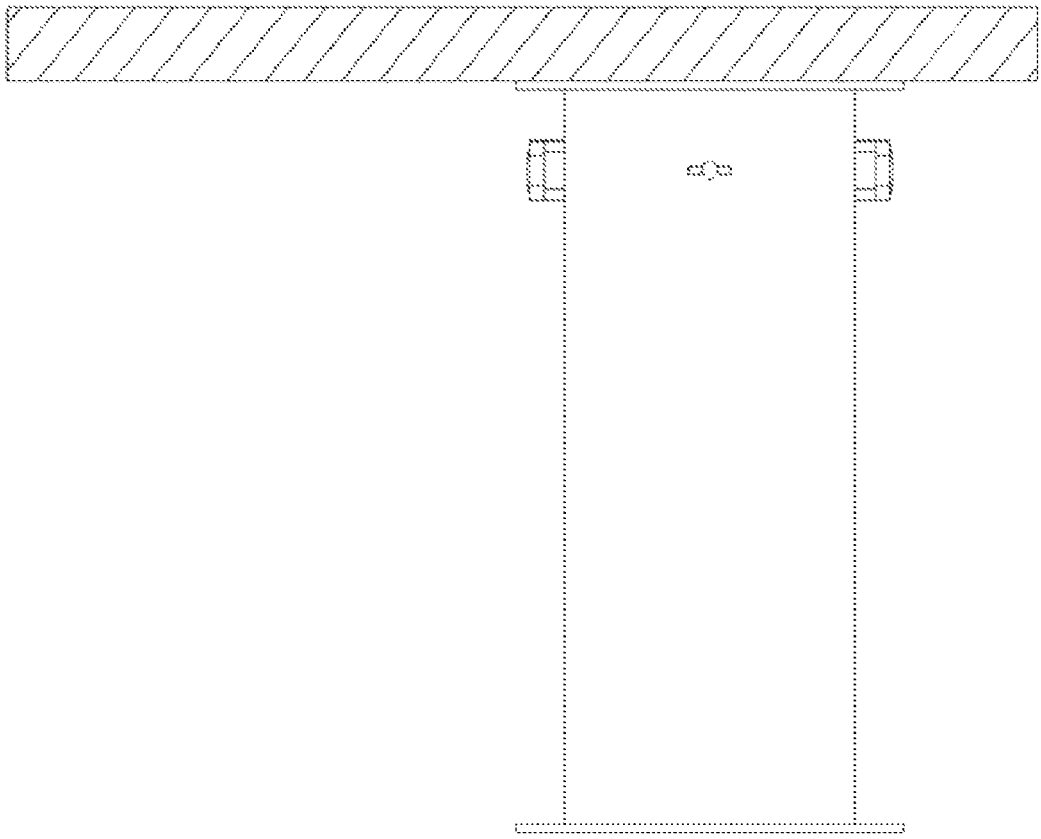
Figure 11:
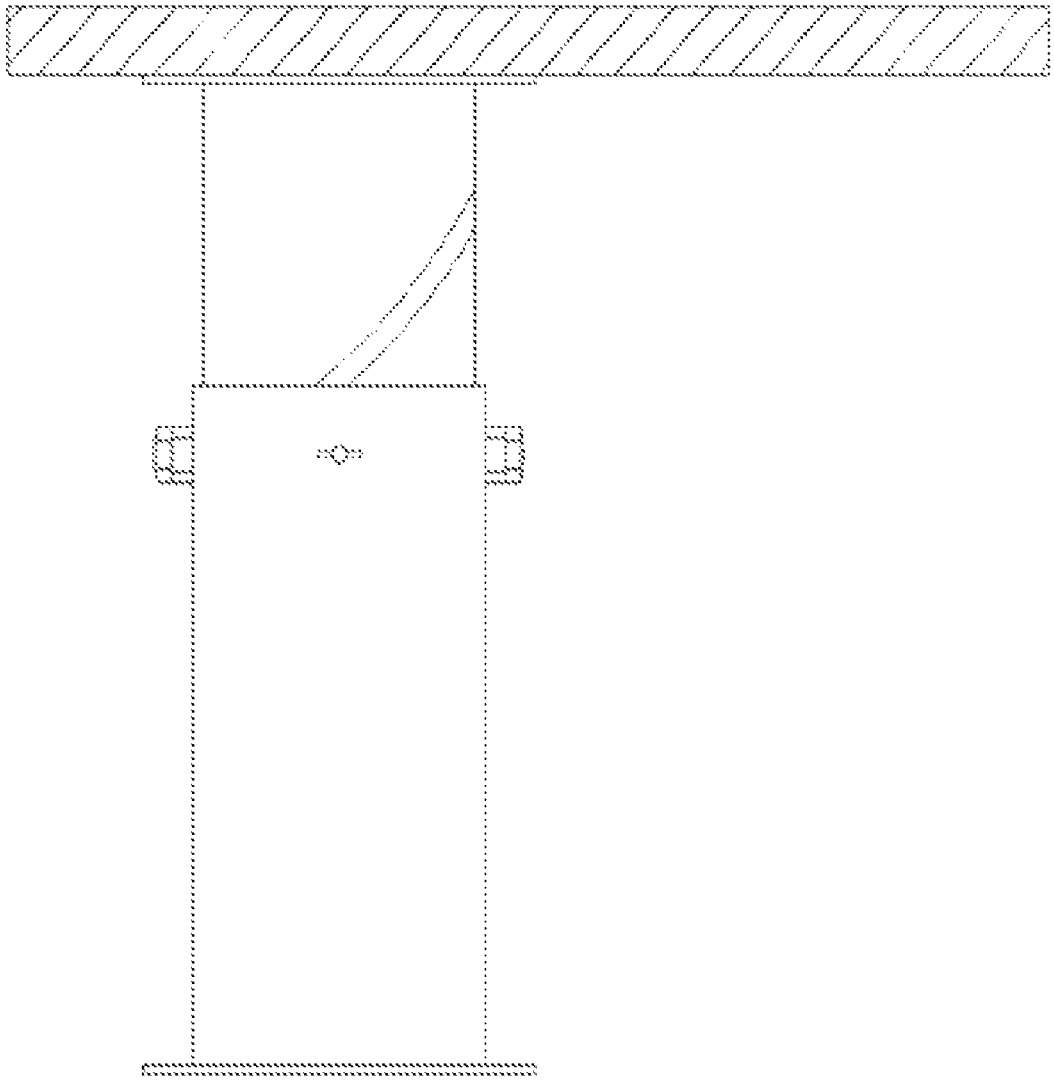

In this way. the table-top screwed in eccentric position, FIG. 9. to the "B Cylinder", clue to the twist of the helical longitudinal milling on pivot anchors, reduce the distance from seating during the raising phase (dining-table), FIG. 11. and increment the distance during the lowering phase (couch-table), FIG. 10.

Inside the Cylinders can be optionally installed in a foreseen environment a telescopic hydraulic actuator. FIG. 8 (5).

Details of use, application and production of the invention can be different but without any change from the domain of the invention itself.

BEST MODE FOR CARRYING OUT THE INVENTION

The Cylinders can be realised using stainless alloy AISI 316L. suggested for maritime use. The small metallic elements needed for the Cylinders final assembly will be realised using stainless alloy and plastic material, as nylon and derlin. The Cylinders diameter can be varying in accordance with weight and dimension of the table-top to be implemented.

In case of motorised use of the structure a hydraulic telescopic actuator with a thrust power proportional to the weight of the Cylinders and of the table-top selected by the end-user. Related to the table-top different type of wood or methacrylate ester can be selected. In any case different materials can be implemented in accordance with the customer requirements. The table-top can be easily design to assume round, rectangular or oval shaping. In any of the previous table-top shape can be added overturning decks to increase the available surface.

The invention claimed is:

1. A table with an adjustable height, comprising:

a first hollow cylindrical element having a first diameter;

a second cylindrical element located within, and concentric with, the first cylindrical element, wherein the second cylindrical element includes a second diameter smaller than the first diameter such that the second cylindrical element may move within the first cylindrical element, and wherein the second cylindrical element has a top end and a bottom end;

a tabletop coupled to a top of the second cylindrical element, wherein the tabletop extends laterally to a right side a first distance and extends laterally to a left side a second distance, wherein the first and second distances are not equal;

a first curve-shaped slit located in the surface of the second cylindrical element, wherein the first carve-shaped slit travels from substantially the top end of the second cylindrical element towards the bottom end of the second cylindrical element, and wherein the first curved shaped slit travels at least 180 degrees around a circumference of the second cylindrical element;

a first orifice located in the surface of the first cylindrical element, wherein the location of the first orifice aligns with a location of the first curve-shaped slit; and a first fastener that extends through the first orifice and the first curve-shaped slit, thereby fastening the first, cylindrical element with the second cylindrical element;

wherein when the second cylindrical element is not extended, the first fastener extends through the first orifice and a top of the first curve-shaped slit, and wherein when the second cylindrical element is extended, the tabletop is rotated at least 180 degrees so that the first fastener extends through the first orifice and a bottom of the first curve-shaped slit such that the tabletop extends laterally to the right side a second distance and extends laterally to the left side a first distance.

2. The table of claim 1, further comprising a flange coupled to a bottom of the first hollow cylindrical element, wherein the flange is secured to a floor.

3. The table of claim 2 further comprising a plurality of orifices located around a circumference of the flange such that each orifice, accepts a bolt that extends through the orifice and to the floor.

4. The table of claim 2, further comprising a fastener that extends through the first hollow cylindrical element and contacts an exterior surface of the second cylindrical element, thereby making a friction fit with the second cylindrical element.

5. The table of claim 4, further comprising a second flange coupled to a top of the second hollow cylindrical element wherein the second flange is coupled to a bottom surface of the tabletop.

6. The table of claim 5, further comprising a plurality of orifices located around a circumference of the second flange such that each orifice accepts a bolt that extends through the orifice and to the floor.

7. The table of claim 5, wherein the tabletop comprises a quadrilateral shape with four right angles, and wherein the flange of the second hollow cylindrical element is coupled to the bottom surface of the tabletop at a location other than a midpoint of the tabletop.

8. The table of claim 1, further comprising a second curve-shaped slit located in the surface of the second cylindrical element on an opposite side as the first curve-shaped slit, wherein the second curve-shaped slit travels from substantially the top end of the second cylindrical element towards the bottom end of the second cylindrical element, and wherein the second curved shaped slit travels at least 180 degrees around a circumference of the second cylindrical element.

9. The table, of claim 8, further comprising a second orifice located in the surface of the first cylindrical element on an opposite side as the first orifice, wherein the location of the second orifice aligns with the location of the second curve-shaped slit.

10. The table of claim 9, further comprising a second fastener that extends through the second orifice and the second curve-shaped slit, thereby fastening the first cylindrical element with the second cylindrical element.

11. The table of claim 10, wherein when the second cylindrical element is not extended, the second fastener extends through the second orifice and a top of the second curve-shaped slit.

12. The table of claim 11, wherein when the second cylindrical element is extended, the tabletop is rotated at least 180 degrees so that the second fastener extends through the second orifice and a bottom of the second curve-shaped slit such that the tabletop extends laterally to the right side a second distance and extends laterally to the left side a first distance.

13. A table with an adjustable height, comprising:

a first hollow cylindrical element having a first diameter;

a second cylindrical element located within, and concentric with, the first cylindrical element, wherein the second cylindrical element includes a second diameter smaller than the first diameter such that the second cylindrical element may move within the first cylindrical element, and wherein the second cylindrical element has a top end and a bottom end;

a tabletop coupled to a top of the second cylindrical element, wherein the tabletop extends laterally to a right side a first distance and extends laterally to a left side a second distance, wherein the first and second distances are not equal;

a first curve-shaped slit located in the surface of the second cylindrical element, wherein the first curve-shaped slit travels from substantially the top end of the second cylindrical element towards the bottom end of the second cylindrical element, and wherein the first curved shaped slit travels at least 180 degrees around a circumference of the second cylindrical element;

a second curve-shaped slit located in the surface of the second cylindrical element on an opposite side as the first curve-shaped slit, wherein the second curve-shaped slit travels from substantially the top end of the second cylindrical element towards the bottom end of the second cylindrical element, and wherein the second curved shaped slit travels at least 180 degrees around a circumference of the second cylindrical element;

a first orifice located in the surface of the first cylindrical element, wherein the location of the first orifice aligns with the location of the first curve-shaped slit;

a second orifice located in the surface of the first cylindrical element on an opposite side as the first orifice, wherein the location of the second orifice aligns with the location of the second curve-shaped slit;

a first fastener that extends through the first orifice and the first curve-shaped slit, thereby fastening the first cylindrical element with the second cylindrical element;

a second fastener that extends through the second orifice and the second curve-shaped slit, thereby fastening the first cylindrical element with the second cylindrical element;

wherein when the second cylindrical element is not extended, the first fastener extends through the first orifice and a top of the first, curve-shaped slit, and the second fastener extends through the second orifice and a top of the second curve-shaped slit and wherein when the second cylindrical element is extended, the tabletop is rotated at least 180 degrees so that the first fastener extends through the first orifice and a bottom of the first curve-shaped slit and the second fastener extends through the second orifice and a bottom of the second curve-shaped slit such that the tabletop extends laterally to the right side a second distance and extends laterally to the left side a first distance.

14. The table of claim 13, further comprising a flange coupled to a bottom of the first hollow cylindrical element, wherein the flange is secured to a floor.

15. The table of claim 14, further comprising a plurality of orifices located around a circumference of the flange such that each orifice, accepts a bolt that extends through the orifice and to the floor.

16. The table of claim 14, further comprising a fastener that extends through the first hollow cylindrical element and contacts an exterior surface of the second cylindrical element, thereby making a friction fit with the second cylindrical element.

17. The table of claim 16, further comprising a second flange coupled to a top of the second hollow cylindrical element, wherein the second flange is coupled to a bottom surface of the tabletop.

18. The table of claim 17, further comprising a plurality of orifices located around a circumference of the second flange such that each Orifice accepts a bolt that extends through the orifice and to the floor.

19. The table of claim 17, wherein the tabletop comprises a quadrilateral shape with four right angles, and wherein the flange of the second hollow cylindrical element is coupled to the bottom surface of the tabletop at a location other than a midpoint of the tabletop.

* * * * *